US012091876B2

(12) United States Patent
Neusch

(10) Patent No.: US 12,091,876 B2
(45) Date of Patent: Sep. 17, 2024

(54) WIRE MESH FENCING

(71) Applicant: Neusch Innovations, LP, Burnet, TX (US)

(72) Inventor: William H. Neusch, Marble Falls, TX (US)

( * ) Notice: Subject to any disclaimer, the term of this patent is extended or adjusted under 35 U.S.C. 154(b) by 0 days.

(21) Appl. No.: 18/521,828

(22) Filed: Nov. 28, 2023

(65) Prior Publication Data

US 2024/0093530 A1 Mar. 21, 2024

Related U.S. Application Data

(63) Continuation of application No. 18/121,232, filed on Mar. 14, 2023, now Pat. No. 11,879,261, which is a continuation of application No. 29/885,724, filed on Feb. 28, 2023.

(60) Provisional application No. 63/319,743, filed on Mar. 14, 2022.

(51) Int. Cl.
*E04H 17/16* (2006.01)

(52) U.S. Cl.
CPC ..... *E04H 17/168* (2013.01); *E04H 17/161* (2013.01)

(58) Field of Classification Search
CPC ..... E04H 17/14; E04H 17/16; E04H 17/161; E04H 17/163; E04H 17/168; E04H 17/17; E04H 17/1413; E04H 17/1447; E04H 17/1456; E04H 17/1465; E04H 17/1486; E04H 17/1488
See application file for complete search history.

(56) References Cited

U.S. PATENT DOCUMENTS 1,567,446 A * 12/1925 McClure ..... E04H 17/163 211/153
5,542,649 A 8/1996 Allegaert et al.
5,964,452 A * 10/1999 Summers ..... F16B 9/054 256/60
6,010,116 A 1/2000 Knott, Sr.
6,415,564 B1 * 7/2002 Beer ..... E04H 17/166 256/54

(Continued)

FOREIGN PATENT DOCUMENTS

BE 1008506 A3 * 5/1996 ..... E04H 17/163
CA 2869892 A1 * 4/2015 ..... E04F 11/1834

(Continued)

OTHER PUBLICATIONS

Wireworks Anti-Climb Gate drawings, Ameristar Assa Abloy, Ameristarfence.com, 2 pages.
Wireworks Anti-Climb Brochure, 4 pages.

*Primary Examiner* — Jonathan P Masinick
(74) *Attorney, Agent, or Firm* — Bradley Arant Boult Cummings LLP; Henry L. Ehrlich

(57) ABSTRACT

A wire mesh fence panel includes a top longitudinal portion of a wire mesh disposed inside of a top rail that is connected to a first post and a second post, a bottom longitudinal portion of the wire mesh that is disposed inside of a bottom rail that is connected to the first and second post, a first vertical portion of the wire mesh disposed inside of the first post, a second vertical portion of the wire mesh disposed inside of the second post, top rail links connecting the top rail to the first and second posts, and bottom rail links connecting the bottom rail to the first and second posts.

20 Claims, 13 Drawing Sheets

(56) References Cited

U.S. PATENT DOCUMENTS

| | | | | |
|---|---|---|---|---|
| D583,964 | S | 12/2008 | Cochrane | |
| D615,670 | S | 5/2010 | Cochrane | |
| 8,636,266 | B2 | 1/2014 | Gill | |
| D754,364 | S | 4/2016 | Cateeuw | |
| 9,428,934 | B1 | 8/2016 | Payne | |
| 9,695,613 | B2 | 7/2017 | Shepherd | |
| D826,427 | S | 8/2018 | Filiba | |
| 10,604,962 | B1 * | 3/2020 | Givens | E04H 17/163 |
| 2006/0226406 | A1 | 10/2006 | Vise et al. | |
| 2008/0179577 | A1 * | 7/2008 | Neusch | E04H 17/16 256/1 |
| 2017/0096835 | A1 | 4/2017 | Messelis | |

FOREIGN PATENT DOCUMENTS

| | | | | |
|---|---|---|---|---|
| DE | 1905122 | A1 * | 8/1970 | |
| DE | 102005033490 | A1 * | 2/2007 | E04H 17/161 |
| DE | 102009044483 | A1 * | 5/2011 | E04F 11/1851 |
| DE | 202015101002 | U1 * | 6/2015 | E04H 17/14 |
| EP | 1132549 | A1 * | 9/2001 | E04H 17/163 |
| EP | 3249139 | B1 * | 7/2019 | E04H 17/161 |
| EP | 3839173 | A1 * | 6/2021 | E04H 17/1417 |
| WO | WO-2009023274 | A1 * | 2/2009 | A01K 1/03 |

* cited by examiner

WIRE MESH FENCING

BACKGROUND

This section provides background information to facilitate a better understanding of the various aspects of the disclosure. It should be understood that the statements in this section of this document are to be read in this light, and not as admissions of prior art.

Welded wire mesh is often used for high security fencing. Commonly, the wire mesh is connected to adjacent posts by fasteners such as bolts, rivets, and clamps that are inexpensive and easy to secure to the wire mesh and posts. The posts, in particular in high security installations, may be I-beams providing additional structural support as well as structure to bolt with the wire mesh. Rails may be connected to upper and lower edges of the wire mesh and secured to the adjacent posts. The rails may provide tension to the wire mesh. Again, the wire mesh is commonly connected to the rails with bolts, rivets, and clamps.

SUMMARY

An exemplary wire mesh fence panel includes a first post spaced laterally from a second post, a wire mesh comprising a perimeter, a top longitudinal portion of the perimeter disposed inside of a top rail, the top rail connected at a first top end to the first post and at a second top end to the second post, a bottom longitudinal portion of the perimeter disposed inside of a bottom rail, the bottom rail connected at a first bottom end to the first post and at a second bottom end to the second post, a first vertical portion of the perimeter disposed inside of the first post, a second vertical portion of the perimeter disposed inside of the second post, a first top rail link connecting the first top end to the first post and a second top rail link connecting the second top end to the second post, and a first bottom rail link connecting the first bottom end to the first post and a second bottom rail link connecting the second bottom end to the second post.

Another exemplar wire mesh fence panel includes a top longitudinal portion of a wire mesh disposed inside of a top rail that is connected to a first post and a second post, a bottom longitudinal portion of the wire mesh that is disposed inside of a bottom rail that is connected to the first and second post, a first vertical portion of the wire mesh disposed inside of the first post, a second vertical portion of the wire mesh disposed inside of the second post, top rail links connecting the top rail to the first and second posts, and bottom rail links connecting the bottom rail to the first and second posts.

An exemplary method of erecting a wire mesh fence includes positioning a first post and a second post to receive and support a wire mesh, where the wire mesh comprises a perimeter and interstices formed by vertical wires intersected by horizontal wires, the first post has a first internal bore and a first vertical slot into the first internal bore, and the second post has a second internal bore and a second vertical slot into the second internal bore, attaching the wire mesh to the first post and the second post, the wire mesh having a top longitudinal portion disposed inside of a top rail and a bottom longitudinal portion disposed inside of a bottom rail, where the attaching includes disposing a first vertical portion of the perimeter through the first vertical slot into the first internal bore, disposing a second vertical portion of the perimeter through the first vertical slot into the first internal bore, attaching the top rail to the first post with a first top rail link having a first rectangular end disposed in the top rail with the top longitudinal portion extending into a first slot in the first rectangular end and a post end with a first cross-hole disposed inside the first post, positioning a first pin in the first cross-hole and an aperture with the first post, attaching the top rail to the second post with a second top rail link having a second rectangular end disposed in the top rail with the top longitudinal portion extending into a second slot in the second rectangular end and a post end with a second cross-hole disposed inside the second post, positioning a second pin in the second cross-hole and an aperture with the second post, connecting the bottom rail to the first post with a first bottom rail link, and connecting the bottom rail to the second post with a second bottom rail link.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion. As will be understood by those skilled in the art with the benefit of this disclosure, elements and arrangements of the various figures can be used together and in configurations not specifically illustrated without departing from the scope of this disclosure.

DETAILED DESCRIPTION

Figure 1:
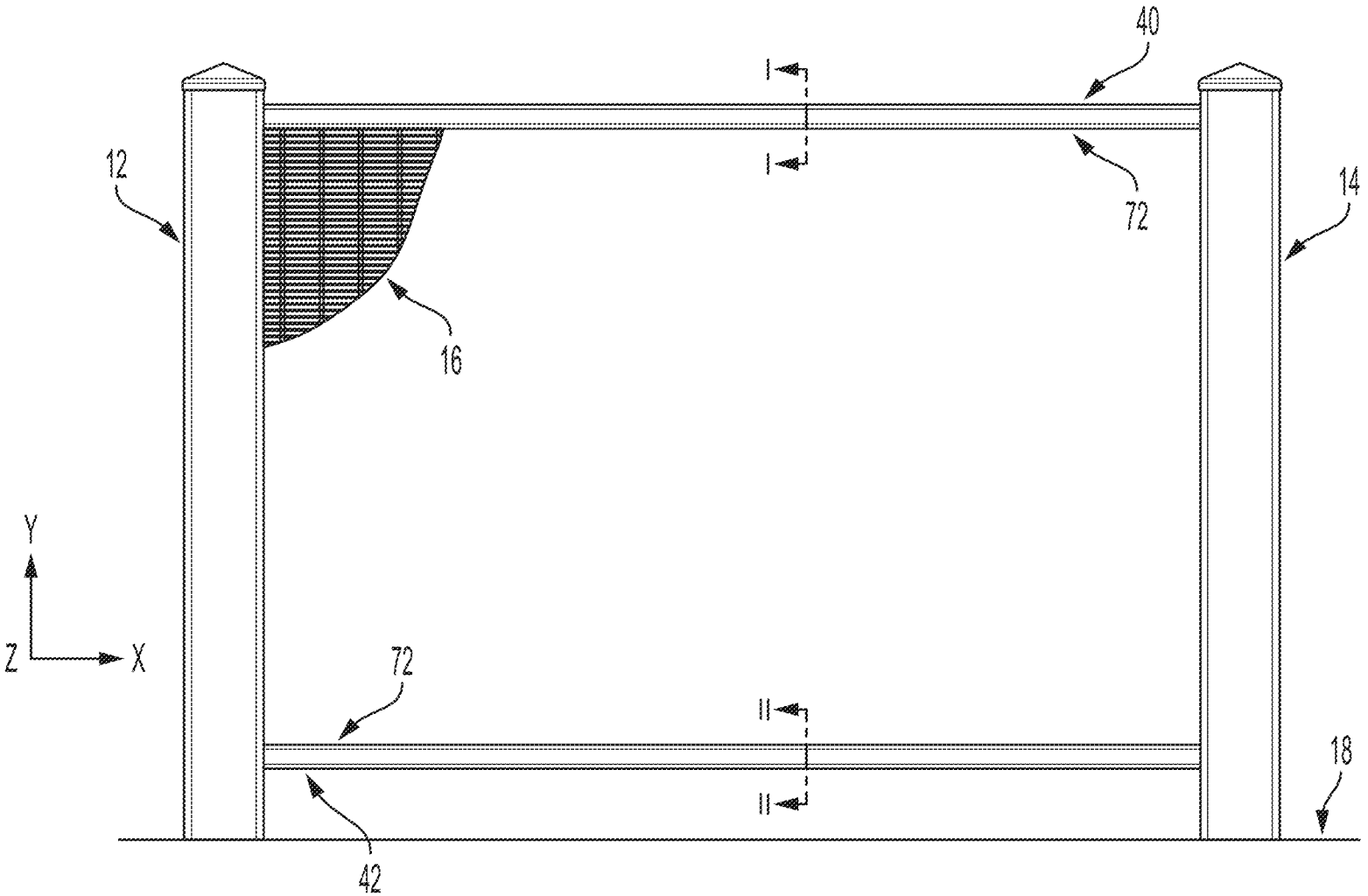
FIG. 1 is an elevation view of an exemplary wire mesh fence panel according to one or more aspects of the disclosure.
Figure 2:
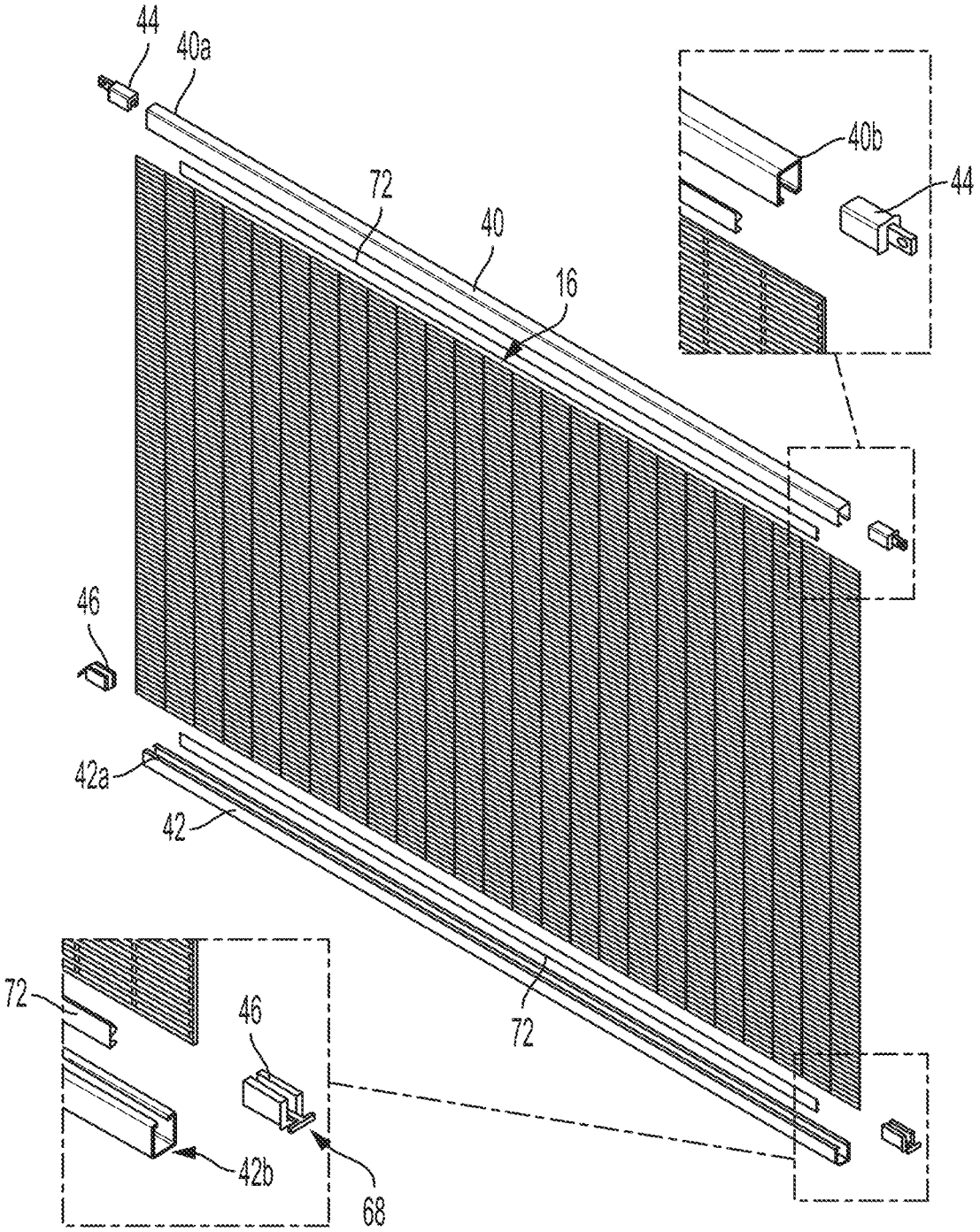
FIG. 2 is an exploded view of aspects of an exemplary wire mesh fence panel.

It is to be understood that the following disclosure provides many different embodiments, or examples, for implementing different features of various illustrative embodiments. Specific examples of components and arrangements are described below to simplify the disclosure. These are, of course, merely examples and are not intended to be limiting. For example, a figure may illustrate an exemplary embodiment with multiple features or combinations of features that are not required in one or more other embodiments and thus a figure may disclose one or more embodiments that have fewer features or a different combination of features than the illustrated embodiment. Embodiments may include some but not all the features illustrated in a figure and some embodiments may combine features illustrated in one figure with features illustrated in another figure. Therefore, combinations of features disclosed in the following detailed description may not be necessary to practice the teachings in the broadest sense and are instead merely to describe particularly representative examples. In addition, the disclosure may repeat reference numerals and/or letters in the various examples. This repetition is for the purpose of simplicity and clarity and does not itself dictate a relationship between the various embodiments and/or configurations discussed.

This disclosure is directed to wire mesh fencing that may be used for example as a security fence and/or anti-climb fence depending in-part on the construction of the wire mesh. The disclosed wire mesh is welded wire mesh, however, aspects of the disclosure and connection with the top and bottom rails and the adjacent posts may be achieved with other wire mesh, such as but not limited to, chicken wire, woven rectangular mesh referred to as chain link and knotted mesh, which may use a third wire wrapped around two wires of the intersecting horizontal and vertical mesh wires to hold the intersections together.

Welded wire mesh has been used for security fences to provide a cut resistant and climb resistant panel. Such security fences are made by welding intersecting first wires and second wires forming small interstices that make it difficult to get a foothold on the fence and difficult to use a cutting implement to sever the welded heavy steel wire, e.g., galvanized wire. For example, "prison mesh," is a 358 high security anti-climbing and anti-cutting welded wire fence with 3-inch by 0.5-inch mesh openings and 8-gauge wire. Again, aspects of the disclosure are not limited to high security fences. As will be understood by those skilled in the art, the wire mesh, e.g., welded wire mesh, may have different materials and sizes. For example, and without limitation, the mesh may have 12-gauge to 4-gauge wire connected with 3"×0.5" interstices, 1"×1" interstices, 2"×2" interstices, and 2"×6" interstices.

The figures disclose exemplary wire mesh fence panels and wire mesh fence sections. Aspects of the disclosure include apparatus and methods for securing perimeter portions of the wire mesh to steel members. The attachment of the wire mesh perimeter with the steel members provides both an aesthetically clean and pleasing connection and covert connections to deter unauthorized disassembly of the fencing. According to aspects of the disclosure, fasteners do not fully extend through the steel members or around the steel members as in conventional fencing. For example, fasteners may be fully located inside of the steel members or only accessible through an opening through the steel member.

Exemplary wire mesh fence panels, generally denoted by the number 10, are now described with reference to FIGS. 1-22. FIG. 1 illustrates an exemplary wire mesh fence panel 10 comprising a first post 12 spaced laterally from a second post 14 and a wire mesh 16 extending between and connected to the first and second posts. Posts 12 and 14 extend vertically from the ground 18. FIG. 1 depicts three mutually orthogonal directions X, Y, Z forming a three-dimensional frame of reference. The X-axis corresponds to the lateral or longitudinal axis of the wire mesh fence panel and the Y-axis corresponds to the vertical axis of the wire mesh fence panel, where the wire mesh extends in the X-Y plane. In the illustrated example, wire mesh 16 is a welded wire mesh and posts 12 and 14 are steel posts, e.g., 6-inch posts.

Figure 3:
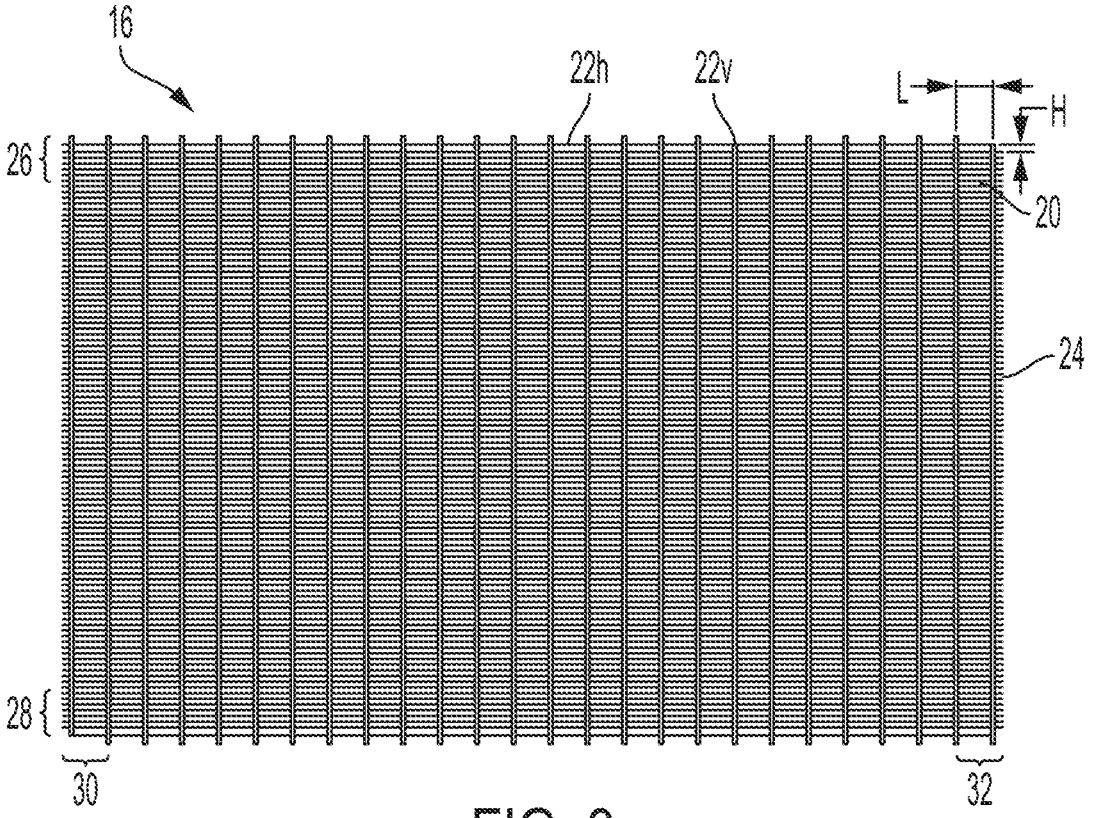
FIG. 3 illustrates an exemplary wire mesh for use in a wire mesh fence panel.

With reference to all the figures, wire mesh 16 is constructed of interstices 20 of intersecting wires, generally denoted with the numeral 22. With reference in particular to FIG. 3, wires 22 include substantially parallel vertical wires 22*v* and substantially parallel lateral wires 22*h*. Each interstices 20 has a lateral length "L" defined by the distance between adjacent vertical wires 22*v* and a height "H" defined by the distance between adjacent lateral wires 22*h*. For example, a 358 welded wire mesh has interstices 20 with a length of 3-inches and a height of 0.5 inches and the wires are 8-guage. Wire mesh 16 is a parallelogram having a perimeter 24. Perimeter 24 includes a top longitudinal portion 26, a bottom longitudinal portion 28, first vertical portion 30, and a second vertical portion 32. Longitudinal portions 26, 28 include at least one lateral wire 22*h* and the vertical portions 30, 32 include at least one vertical wire 22*v*. The length of the vertical portions and the height of the longitudinal portions may vary. In an exemplary embodiment, vertical portions 30, 32 have a lateral length of about 5-inches that are disposed in the respective first and second posts.

Posts 12, 14 are tubular members having an internal bore 34 (FIGS. 8, 11, 15) and a vertical slot 36 (FIGS. 8-10) in which wire mesh 16 extends into bore 34. Slot 36 does not extend vertically the full length of the post. For example, with reference to FIG. 8, slot 36 terminates prior to top end 38*t* of each post 12, 14, and at a bottom end 36*b* prior to the bottom end 38*b* of each post.

Top rail links 44 connect the first end 40*a* of top rail 40 to first post 12 and the second end 40*b* to second post 14. Bottom rail links 46 connect the first end 42*a* of bottom rail 42 to first post 12 and the second end 42*b* to second post 14.

Figure 6:
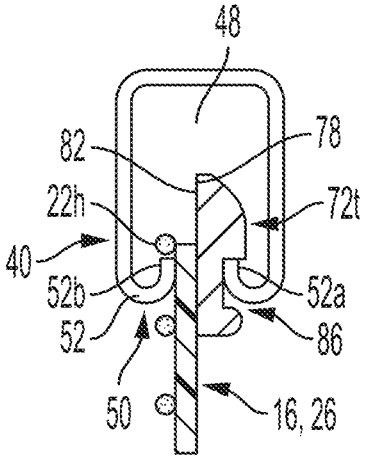
FIG. 6 is a view along line I-I of FIG. 1 showing an exemplary connection of the wire mesh to a top rail.
Figure 7:
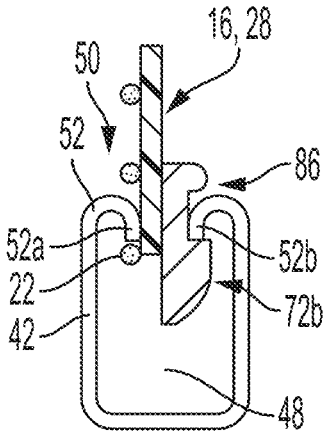
FIG. 7 is a view along line II-II of FIG. 1 showing an exemplary connection of the wire mesh to a bottom rail.
Figure 8:
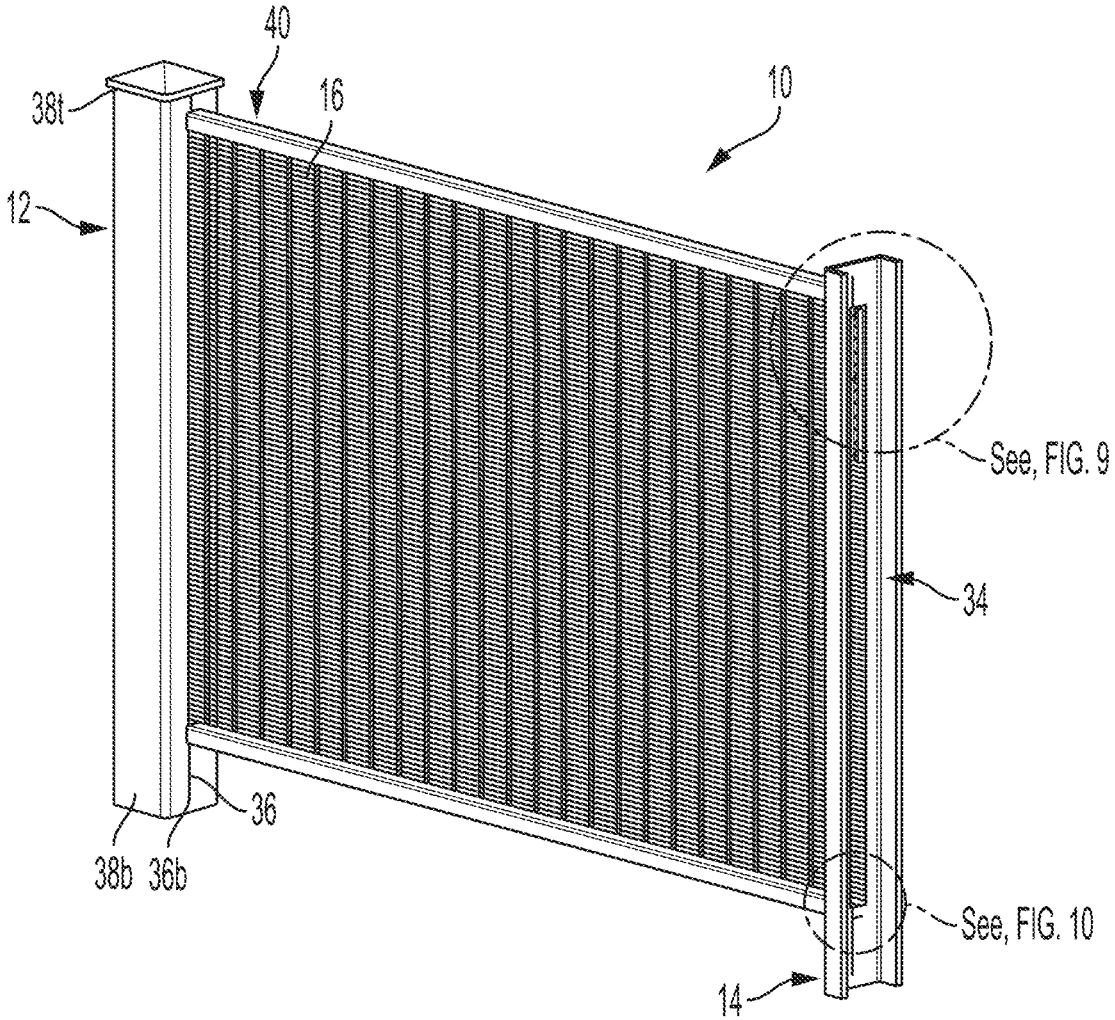
FIG. 8 is an illustration of an exemplary wire mesh fence panel with a portion of a post removed to reveal connection of the wire mesh to the post.

In an exemplary embodiment, such as illustrated in FIGS. 6 and 7, rails 40 and 42 are tubular C-section members having a bore 48 open at the first and second ends. A rail slot 50 is formed through a first side 52 of the rail into bore 48. Rail slot 50 is formed by opposing legs 52*a*, 52*b* of first side 52. In an exemplary embodiment, opposing legs 52*a*, 52*b* extend into bore 48.

Figure 20:
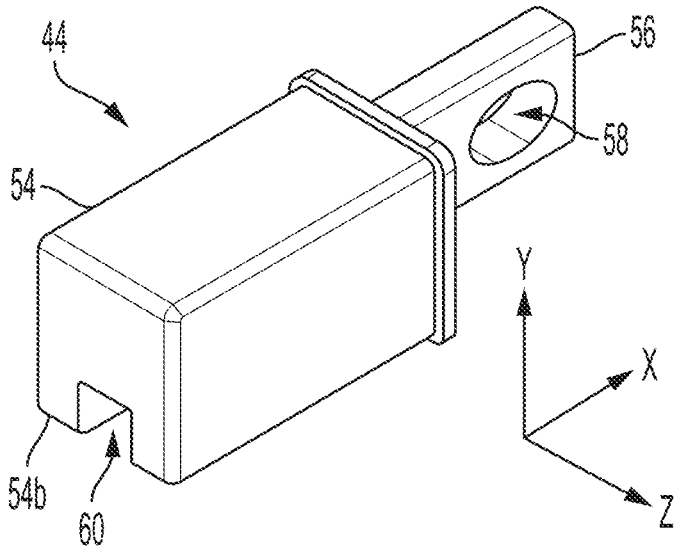
FIG. 20 illustrates an exemplary top rail link.

An exemplary top rail link 44 is illustrated in FIG. 20. Top rail link 44 comprises a rectangular end 54 configured to fit inside of bore of the top rail and a second end 56 in the form of a vertical (Y-axis) plate having a cross-hole 58. Rectangular end 54 also includes a slot or groove 60 in the bottom side 54*b* and extending in the longitudinal direction to dispose a portion of the perimeter of the wire mesh.

Figure 21:
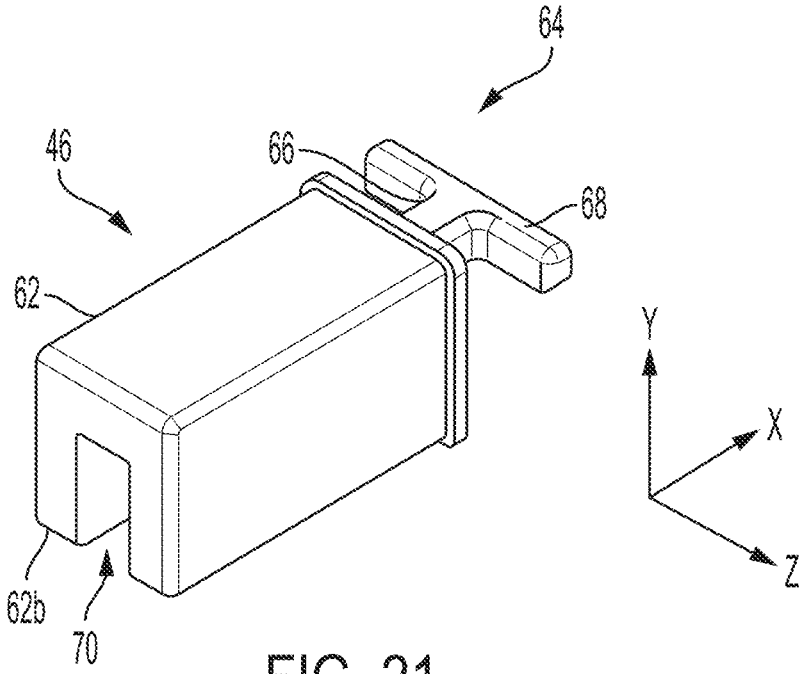
FIG. 21 illustrates an exemplary bottom rail link.

An exemplary bottom rail link 46 is illustrated in FIG. 21. Bottom rail link 46 comprises a rectangular end 62 extending longitudinally to a second end 64. Second end 64 is T-shaped having a post 66 extending longitudinally and a crossbar 68 perpendicular to the X-Y plane. Rectangular end 62 also includes a slot or groove 70 in the bottom side 62*b* and extending in the longitudinal direction to dispose a portion of the perimeter of the wire mesh. Crossbar 68 is disposed into the post by turning link 46 so that crossbar 68 is vertical, inserting crossbar 68 through the slot in the post and then turning link 46 back to crossbar 68 being perpendicular to the X-Y plane.

Figure 4:
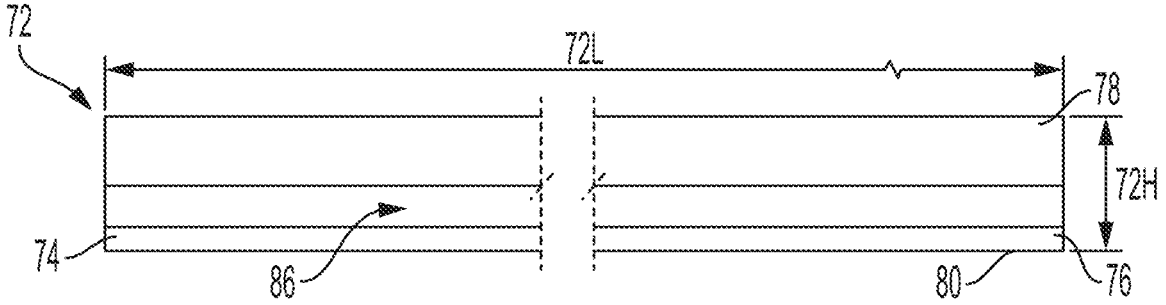
FIG. 4 is an elevation view of an exemplary wire mesh to rail fastener.
Figure 5:
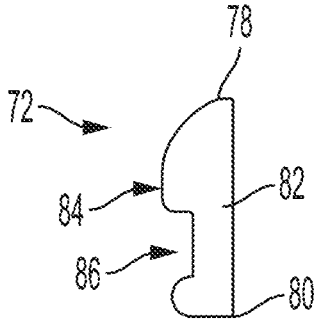
FIG. 5 is an end view of the exemplary wire mesh to rail fastener of FIG. 4.

Top longitudinal portion 26 of the wire mesh is disposed inside of a top rail 40 and the bottom longitudinal portion 28 is disposed inside of a bottom rail 42. A rail fastener 72 is used to secure the wire mesh to the top and bottom rails by wedging the wire mesh in the slots of the rails. An exemplary rail fastener 72 is illustrated in FIGS. 4 and 5. Rail fastener 72 is an elongated member having a length 72L from a first end 74 to a second end 76 that may be approximate to the length of rails 40, 42 and a height 72H from a first edge 78 and a second edge 80. A planar back side 82 extends from first edge 78 to second edge 80. The front side 84, opposite the planar back side, has a groove 86 extending the length 72L. Groove 86 is recessed into front side 84 toward back side 82.

FIG. 6 illustrates a top rail fastener 72*a* connecting a top longitudinal portion 26 of wire mesh 16 in top rail 40. Top longitudinal portion 26 is positioned in rail slot 50 with an outermost longitudinal wire 22*h* positioned in bore 48. Rail fastener 72*t* is positioned with back side 82 against the wire mesh on the opposite side from the longitudinal wires. First edge 78 is pushed into and through rail slot 50 until first opposing leg 52*a* is located in and trapped in groove 86. Rail fastener 72*t* wedges the wire mesh in rail slot 50 with outermost horizontal wire and the portion of the rail fastener between groove 86 and first edge 78 positioned on the opposing legs 52*a*, 52*b* thereby blocking the wire mesh from being pulled through rail slot 50 in the direction of first side 52. FIG. 7 illustrates a bottom rail fastener 72*b* connecting a lower longitudinal portion 28 of wire mesh 16 to bottom rail 42 in the same manner as FIG. 6.

Figure 9:
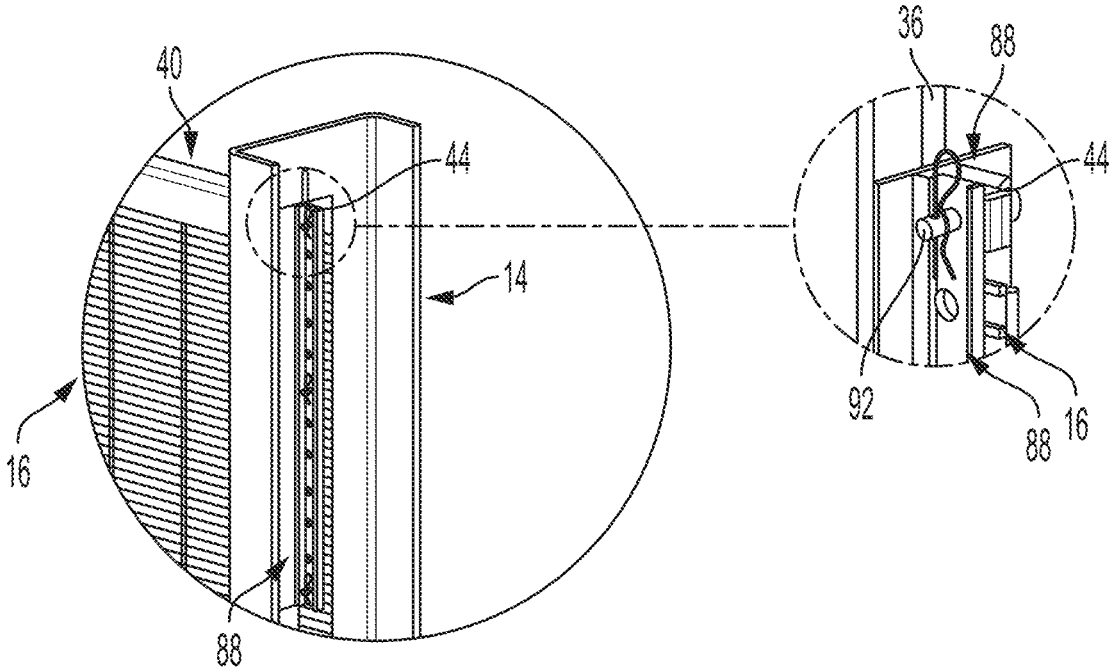
FIG. 9 is a detail view of a wire mesh to post connection of FIG. 8.
Figure 12:
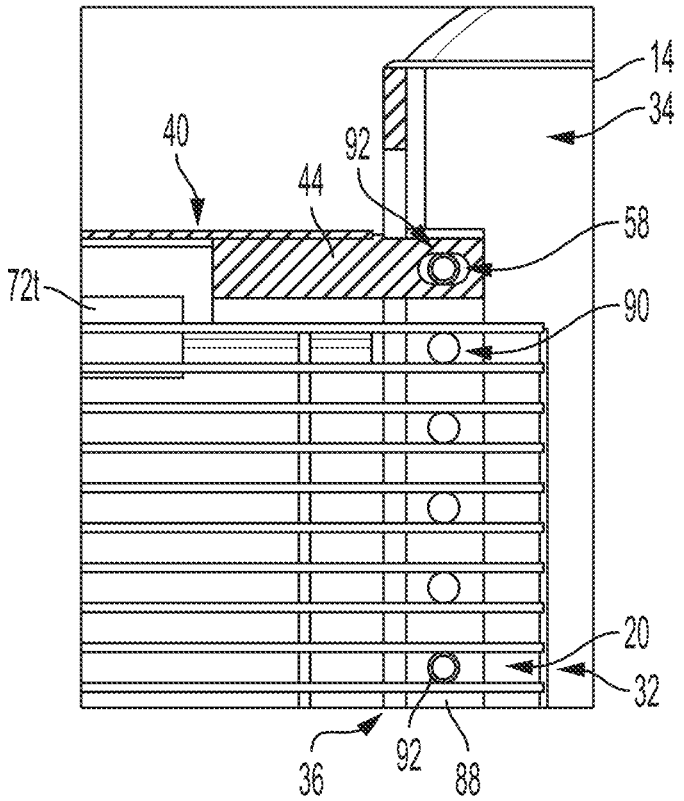
FIG. 12 is a detail view of an exemplar connection of the top rail and wire mesh to a post of FIG. 11.

FIGS. 9 and 12 illustrate top rail 40 and vertical portion 32 of the wire mesh connected to second post 14. The posts have a vertical bar 88, e.g., angle iron, which is attached, e.g., welded, to the post inside post bore 34. Vertical bar 88 is positioned next to post slot 36 and extends parallel to post slot 36. Vertical bar 88 includes vertically separated holes 90. Top rail link 44 extends from top rail 40 through post slot 36 and cross-hole 58 is aligned with one of the holes 90 in the vertical bar. A pin 92 is positioned in cross-hole 58 and the vertical bar securing the top rail to the post. Vertical portion 32 is disposed through post slot 36 into post bore 34 and a pin 92 is positioned in a hole 90 and an interstices 20.

Figure 10:
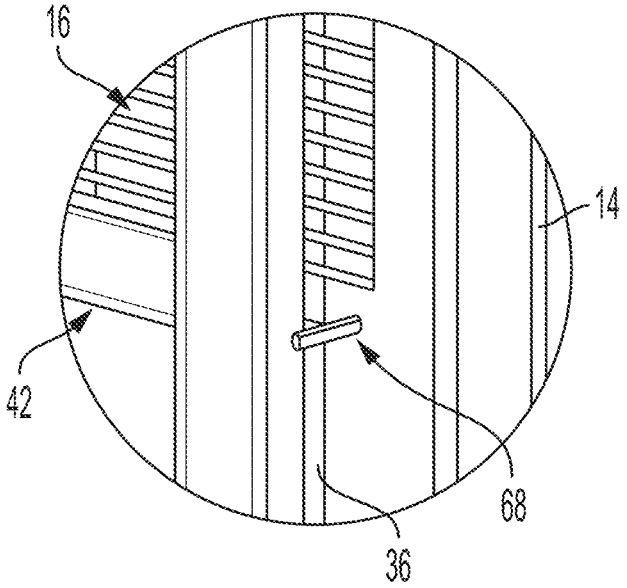
FIG. 10 is a detail view of another wire mesh to post connection of FIG. 8.
Figure 11:
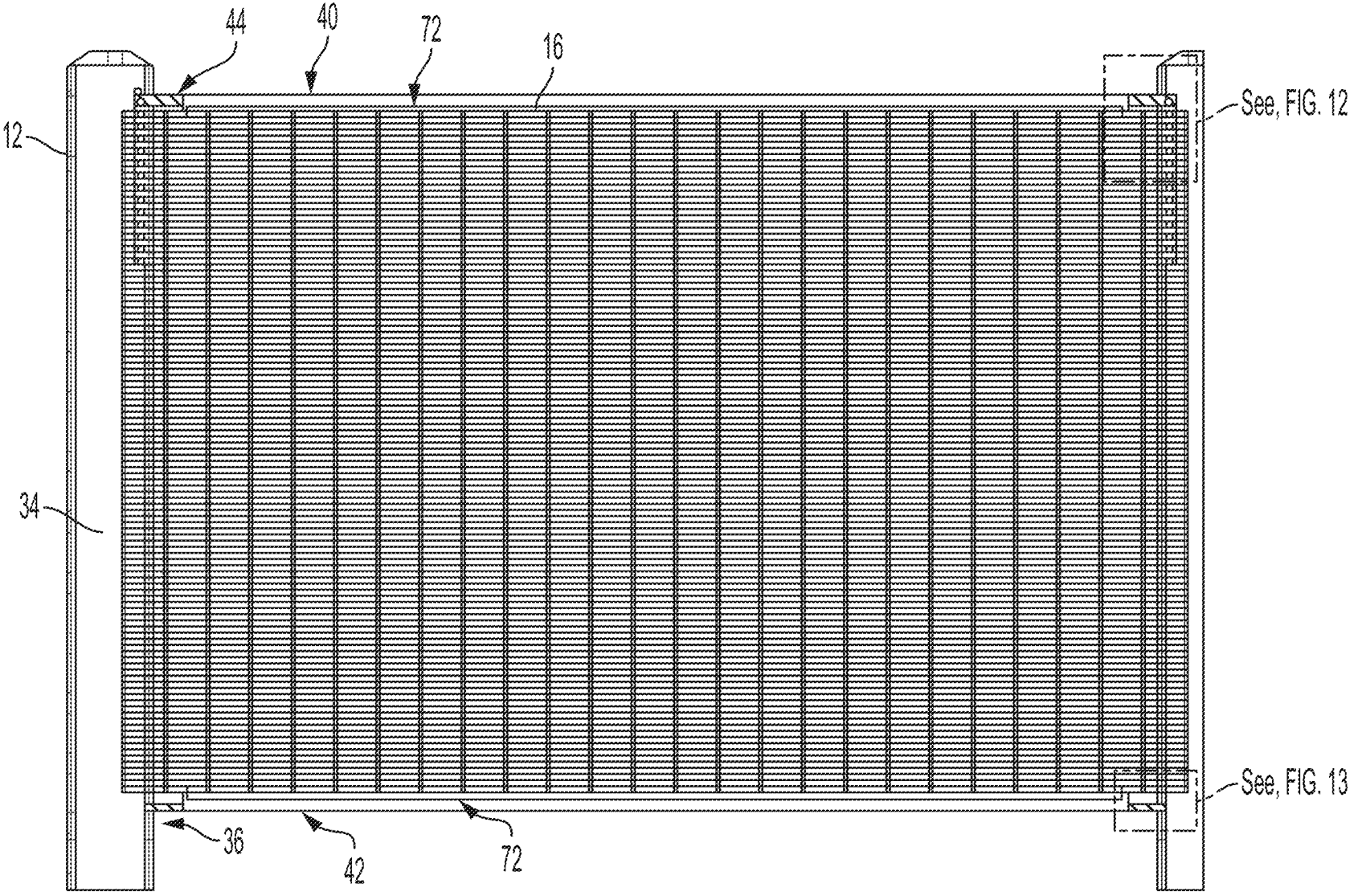
FIG. 11 is a partial sectional elevation view of an exemplary wire mesh fence panel.
Figure 13:
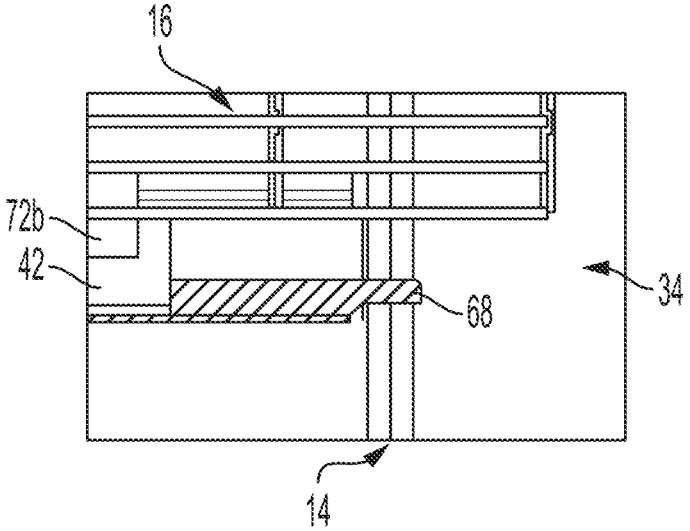
FIG. 13 is a detail view of an exemplary connection of the bottom rail to a post of FIG. 11.

FIGS. 10 and 13 illustrate bottom rail 41 and wire mesh connected to second post 14. Crossbar 68 of the bottom rail link is disposed inside of post bore 34 and is turned to extend laterally so as not to be pulled out of the post through post slot 36. Wire mesh 16 is disposed in second post 14 and bottom rail 42 and the connection of bottom rail 42 to the posts secures the wire mesh with the posts.

Figure 14:
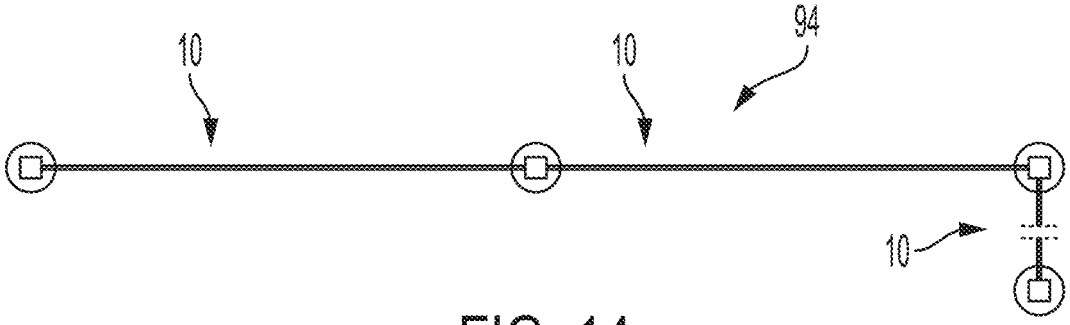
FIG. 14 is a plan view illustrating wire mesh panels erected to form a fence section.
Figure 15:
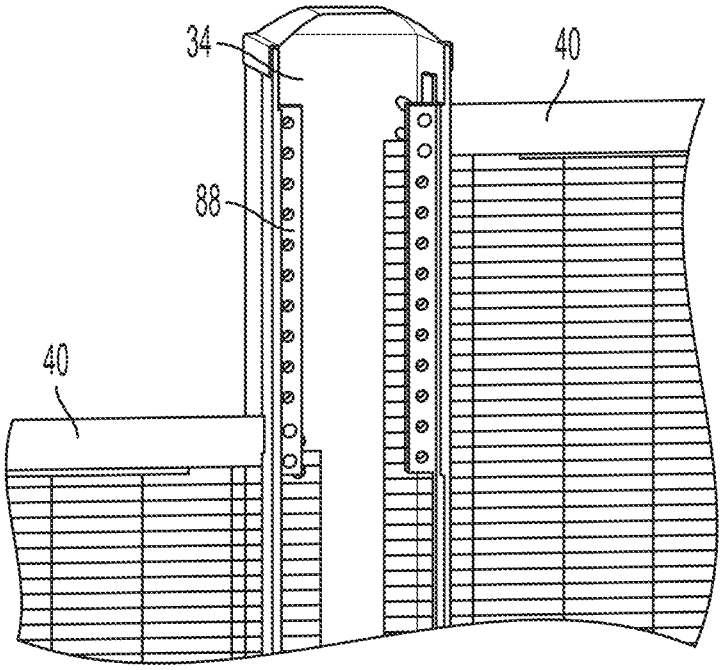
FIG. 15 illustrates connection of adjacent wire mesh panels to a post to create an elevation change in a fence.
Figure 16:
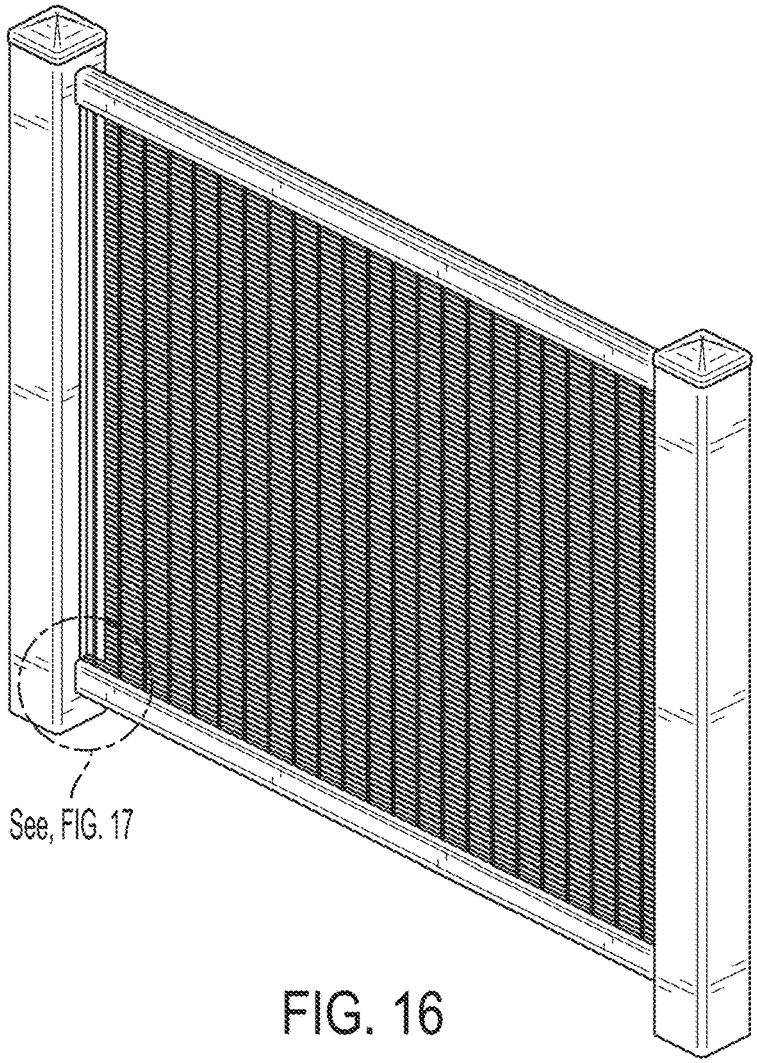
FIG. 16 is a front perspective view of an exemplary wire mesh fence panel illustrating anesthetic features.
Figure 17:
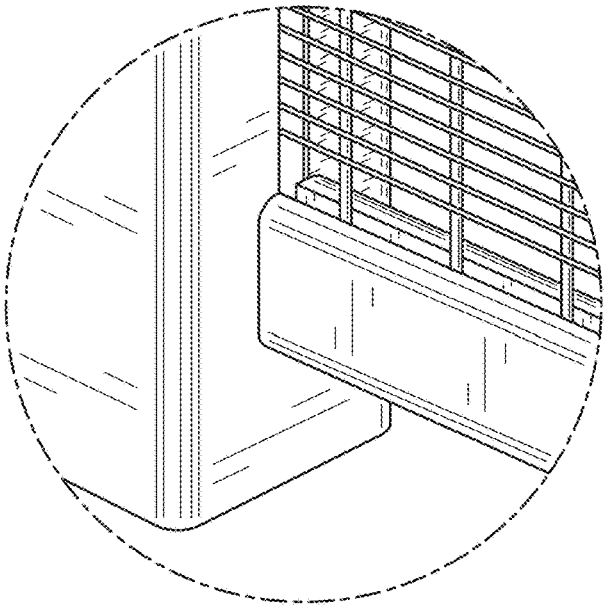
FIG. 17 is a detail of a view of a portion of FIG. 16.
Figure 18:
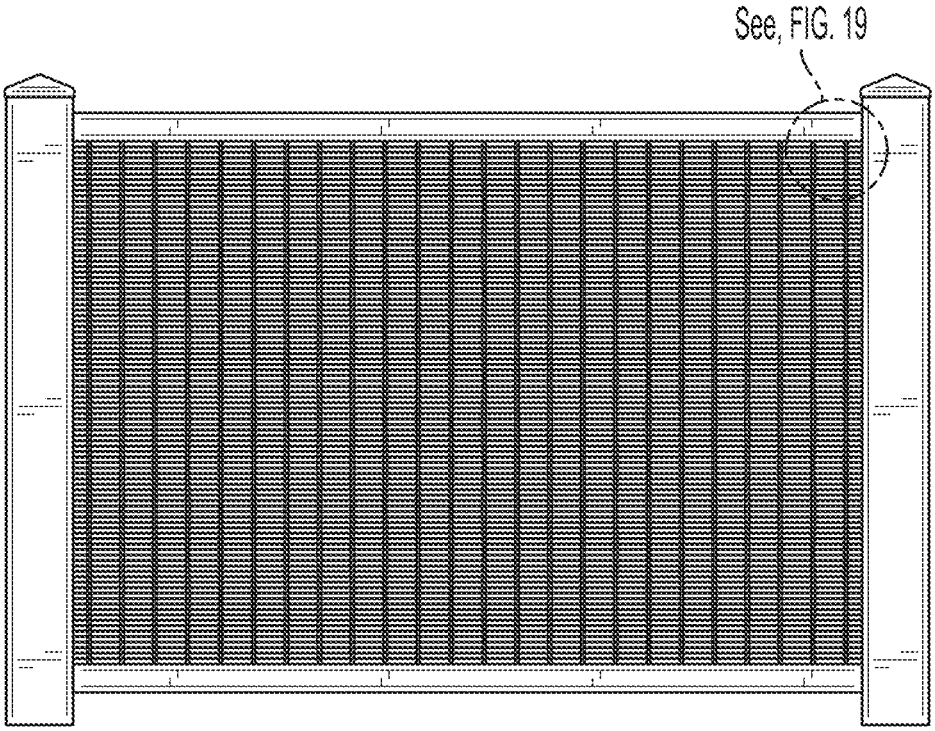
FIG. 18 is a front elevation view of an exemplary wire mesh fence panel illustrating anesthetic features.
Figure 19:
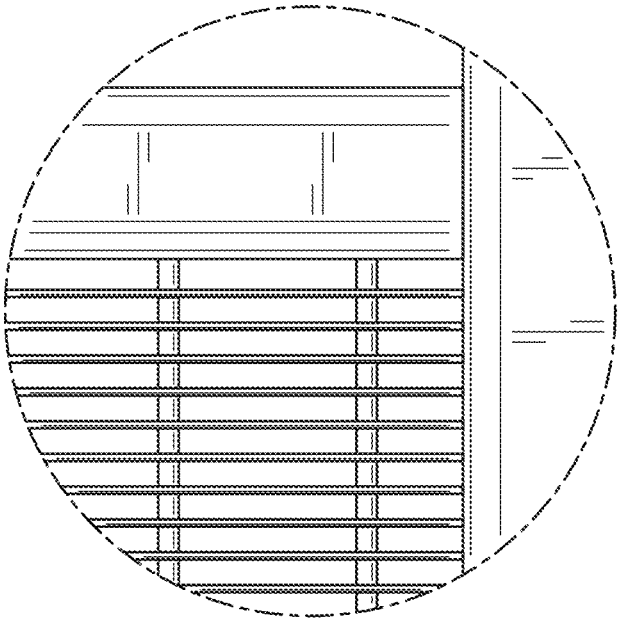
FIG. 19 is a detail of a view of a portion of FIG. 18.

FIG. 14 is a plan view illustrating wire mesh panels 10 interconnected to form a fence 94.

Figure 22A:
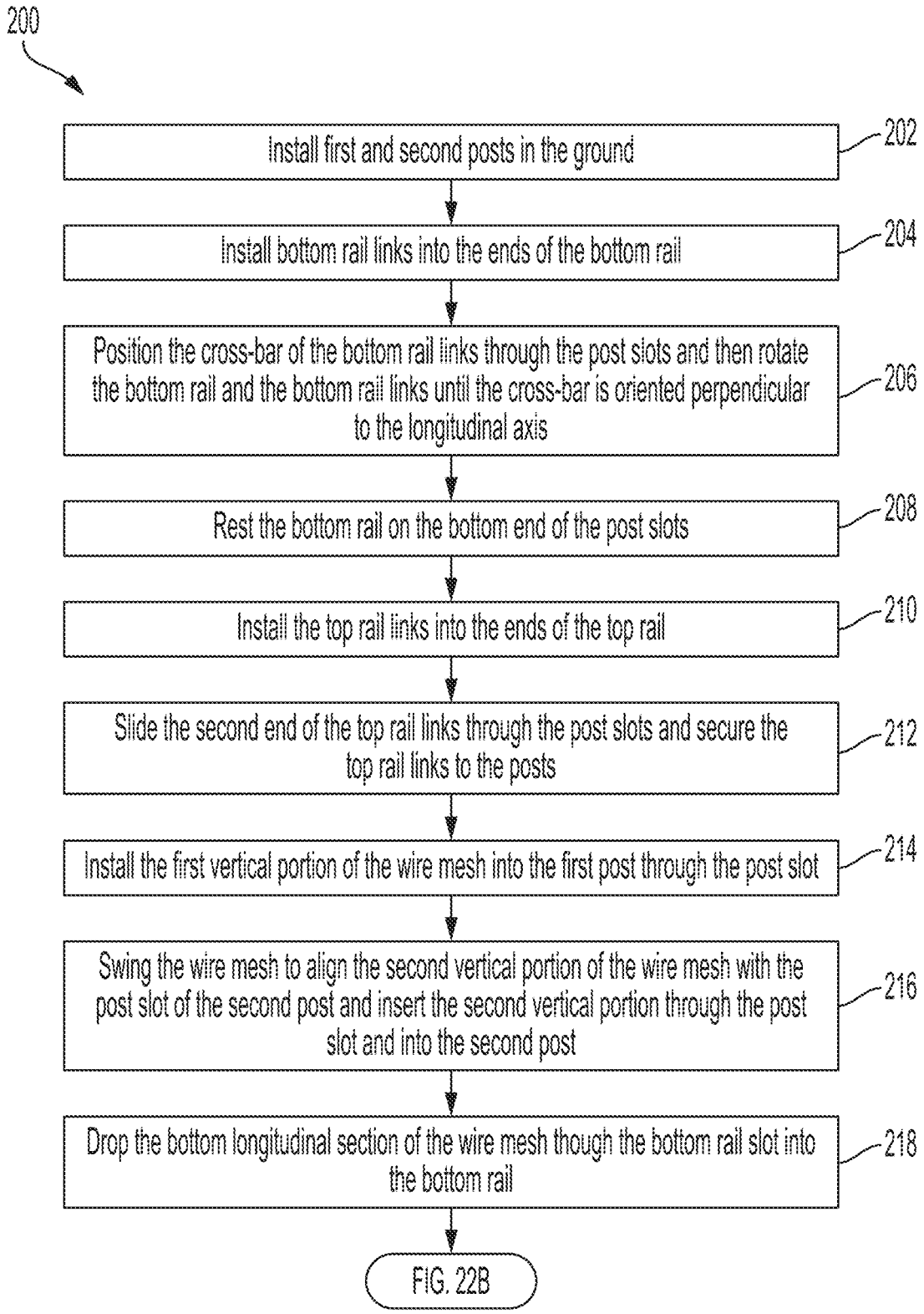
FIGS. 22A and 22B are a block diagram of an exemplary method of erecting a wire mesh fence panel.
Figure 22B:
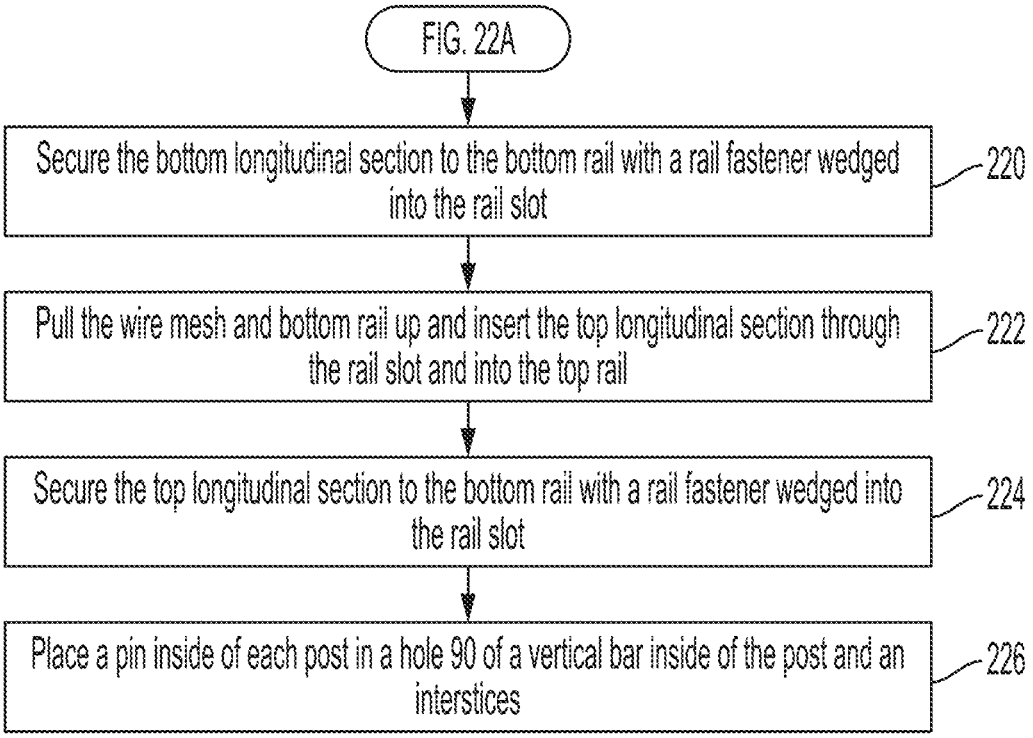

FIG. 22 illustrates an exemplary method 200 of erecting a wire mesh fence panel 10, which is described with reference to FIGS. 1-21. At block 202, posts 12, 14 are installed in the ground, with post slots 36 of each of the posts facing an adjacent post. At block 204, bottom rail links 46 are installed into each end of bottom rail 42. At block 206, at a diagonal angle place crossbar 68 of the T-shaped end through post slots 36 and into the posts and rotate 90 degrees to lock the crossbars inside the posts. At block 208, rest the bottom rail, via the bottom rail links, on the bottom end 36*b* of the post slots 36. At block 210, install top rail links 44 into each end of top rail link 40. At block 212, slide second end 56 of bottom rail links 46 though the posts slots and align cross-hole 58 with a hole 90 in the vertical bar 88 at the desired height and place a pin in the cross-hole 58 and hole 90. At block 214, install first vertical portion 30 of wire mesh 16 into first post 12 through post slot 36. Then, at block 216, swing wire mesh 16 to align with post slot 36 in second post 14 and push second vertical portion 32 into the slot and bore of the second post. Then, at block 218, drop bottom longitudinal portion 28 into rail slot 50 of bottom rail 42 and at block 220 secure wire mesh 16 to bottom rail 46 with a bottom rail fastener 72*b* as described above. Next, at block 222, pull wire mesh 16 and bottom rail 46 up and insert top longitudinal portion 26 into top rail slot 50 and top rail 40 and then, at block 224, secure wire mesh 16 to top rail 40 with a top rail fastener 72*t*. Finally, at block 226, place a second pin 92 inside each post 12, 14 in a hole 90 of vertical bar 88 and an interstice 20 below the first pin connecting the top rail link to the posts.

In accordance with methods and systems disclosed herein, a wire mesh fence panel has not exposed fasteners and is tamper proof. Installation does not require drill holes or tapping screws and all the connections are internal to the fence posts. Installation of the wire mesh to the posts can be completed in five minutes or less.

Although relative terms such as "outer," "inner," "upper," "lower," and similar terms have been used herein to describe a spatial relationship of one element to another, it is understood that these terms are intended to encompass different orientations of the various elements and components in addition to the orientation depicted in the figures. Furthermore, as used herein, the terms "connect," "connection," "connected," "in connection with," and "connecting" may be used to mean in direct connection with or in connection with via one or more elements. Similarly, the terms "couple," "coupling," and "coupled" may be used to mean directly coupled or coupled via one or more elements. The terms "substantially," "approximately," "generally," and "about" are defined as largely but not necessarily wholly what is specified (and includes what is specified; e.g., substantially 90 degrees includes 90 degrees and substantially parallel includes parallel), as understood by a person of ordinary skill in the art. The extent to which the description may vary will depend on how great a change can be instituted and still have a person of ordinary skill in the art recognized the modified feature as still having the required characteristics and capabilities of the unmodified feature.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure and that they may make various changes, substitutions, and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A method of erecting a wire mesh fence, the method comprising:

positioning a first post and a second post to receive and support a wire mesh, wherein:

the wire mesh comprises a perimeter and interstices formed by vertical wires intersected by horizontal wires;

the first post comprises a first internal bore and a first vertical slot into the first internal bore; and the second post comprises a second internal bore and a second vertical slot into the second internal bore; and attaching the wire mesh to the first post and the second post, the wire mesh having a top longitudinal portion disposed inside of a top rail and a bottom longitudinal portion disposed inside of a bottom rail, wherein the attaching comprises:

disposing a first vertical portion of the perimeter through the first vertical slot into the first internal bore;

disposing a second vertical portion of the perimeter through the first vertical slot into the first internal bore;

attaching the top rail to the first post with a first top rail link comprising a first rectangular end disposed in the top rail with the top longitudinal portion extending into a first slot in the first rectangular end and a post end with a first cross-hole disposed inside the first post;

positioning a first pin in the first cross-hole and an aperture with the first post;

attaching the top rail to the second post with a second top rail link comprising a second rectangular end disposed in the top rail with the top longitudinal portion extending into a second slot in the second rectangular end and a post end with a second cross-hole disposed inside the second post;

positioning a second pin in the second cross-hole and an aperture with the second post;

connecting the bottom rail to the first post with a first bottom rail link; and connecting the bottom rail to the second post with a second bottom rail link.

2. The method of claim 1, wherein the wire mesh is welded wire mesh constructed of 12-gauge to 4-gauge wire.

3. The method of claim 1, wherein the wire mesh is 358 wire mesh comprising 8-gauge wire with three inches between the vertical wires and 0.5 inch between the horizontal wires.

4. The method of claim 1, wherein the top longitudinal portion and the bottom longitudinal portion each comprise an outermost horizontal wire and the first vertical portion and the second vertical portion each comprise an outermost vertical wire.

5. The method of claim 1, wherein:

the first top rail link is contained inside the top rail and the first post;

the second top rail link is contained inside the top rail and the second post;

the first bottom rail link is contained inside the bottom rail and the first post; and the second bottom rail link is contained inside the bottom rail and the second post.

6. The method of claim 1, wherein:

the top longitudinal portion is connected to the top rail by a top rail fastener wedging the top longitudinal portion in the top rail; and the bottom longitudinal portion is connected to the bottom rail by a bottom rail fastener wedging the bottom longitudinal portion in the bottom rail.

7. The method of claim 6, wherein the top rail fastener and the bottom rail fastener each comprise an elongated member having a length between a first end and a second end, a height between a first edge and a second edge, a planar back side, and a front side comprising a groove located between the first and second edges and extending to the first end and the second end.

8. The method of claim 7, wherein the first edge of the top rail fastener is located inside the top rail, a portion of the top rail is trapped in the groove, and the second edge of the top rail fastener is located outside of the top rail.

9. The method of claim 1, wherein the top rail comprises a tubular having a bore open at a first top end and a second top end, a rail slot through a first side and extending from the first top end to the second top end.

10. The method of claim 9, wherein the top longitudinal portion is connected to the top rail by a top rail fastener wedging the top longitudinal portion in the top rail.

11. The method of claim 10, wherein:

the top rail fastener comprises an elongated member having a length between a first end and a second end, a height between a first edge and a second edge, a planar back side, and a front side comprising a groove located between the first and second edges and extending to the first end and the second end; and the top rail fastener is positioned in the rail slot of the top rail with the first edge of the top rail fastener located in the bore of the top rail, a portion of the first side of the top rail is trapped in the groove, and the second edge of the top rail fastener is located outside of the top rail.

12. The method of claim 11, wherein:

the rail slot of the top rail is formed by opposing legs in the first side extending into the bore of the top rail; and the portion of the first side trapped in the groove is a leg of the opposing legs.

13. The method of claim 1, wherein the first bottom rail link comprises a rectangular end disposed in the bottom rail and a T-shaped end disposed inside the first post.

14. The method of claim 13, wherein the T-shaped end comprises a crossbar extending perpendicular to a vertical plane of the wire mesh, wherein the T-shaped end is disposed through the first vertical slot in the first post with the crossbar positioned inside of the first post, wherein the crossbar has a width greater than the width of the first vertical slot.

15. A method of erecting a wire mesh fence, the method comprising:

positioning a first post and a second post to receive and support a wire mesh, wherein:

the wire mesh is steel and comprises a perimeter and interstices formed by vertical wires intersected by horizontal wires, where the vertical wires and horizontal wires are 12-gauge or greater, with three inches or less between the vertical wires and about 0.5 inch between the horizontal wires;

the first post comprises a first internal bore and a first vertical slot into the first internal bore; and the second post comprises a second internal bore and a second vertical slot into the second internal bore; and attaching the wire mesh to the first post and the second post, the wire mesh having a top longitudinal portion disposed inside of a top rail and a bottom longitudinal portion disposed inside of a bottom rail, wherein the attaching comprises:

disposing a first vertical portion of the wire mesh through the first vertical slot into the first internal bore;

attaching the top rail to the first post with a first top rail link comprising a first rectangular end disposed in the top rail with the top longitudinal portion extending into a first slot in the first rectangular end and a post end with a first cross-hole disposed inside the first post;

positioning a first pin in the first cross-hole and an aperture with the first post;

attaching the top rail to the second post with a second top rail link comprising a second rectangular end disposed in the top rail with the top longitudinal portion extending into a second slot in the second rectangular end and a post end with a second cross-hole disposed inside the second post;

positioning a second pin in the second cross-hole and an aperture with the second post;

connecting the bottom rail to the first post with a first bottom rail link; and connecting the bottom rail to the second post with a second bottom rail link.

16. The method of claim 15, wherein:

the first top rail link is contained inside the top rail and the first post;

the second top rail link is contained inside the top rail and the second post;

the first bottom rail link is contained inside the bottom rail and the first post; and the second bottom rail link is contained inside the bottom rail and the second post.

17. The method of claim 15, wherein:

the top longitudinal portion is connected to the top rail by a top rail fastener wedging the top longitudinal portion in the top rail; and the bottom longitudinal portion is connected to the bottom rail by a bottom rail fastener wedging the bottom longitudinal portion in the bottom rail.

18. The method of claim 15, wherein:

the first bottom rail link comprises a rectangular end disposed in the bottom rail and a T-shaped end disposed inside the first post; and the T-shaped end comprises a crossbar extending perpendicular to a vertical plane of the wire mesh, wherein the T-shaped end is disposed through the first vertical slot in the first post with the crossbar positioned inside of the first post, wherein the crossbar has a width greater than the width of the first vertical slot.

19. A method of erecting a wire mesh fence, the method comprising:

positioning a first post and a second post to receive and support a wire mesh, wherein:

the wire mesh comprises a perimeter and interstices formed by vertical wires intersected by horizontal wires;

the first post comprises a first internal bore and a first vertical slot into the first internal bore; and the second post comprises a second internal bore and a second vertical slot into the second internal bore;

disposing a top longitudinal portion of the perimeter inside a top rail, wherein the top rail comprises a tubular having a bore open at a first top end and a second top end, a rail slot through a first side and extending from the first top end to the second top end;

attaching the top longitudinal portion to the top rail with a top rail fastener wedging the top longitudinal portion in the top rail, wherein the top rail fastener comprises a member having a length between a first end and a second end, a height between a first edge and a second edge, a planar back side, and a front side comprising a groove located between the first and second edges and extending to the first end and the second end, with the top rail fastener positioned in the rail slot with the first edge located in the bore, a portion of the first side of the top rail trapped in the groove, and the second edge located outside of the top rail;

disposing a bottom longitudinal portion of the perimeter inside a bottom rail;

disposing a first vertical portion of the wire mesh through the first vertical slot into the first internal bore;

attaching the top rail to the first post with a first top rail link comprising a first rectangular end disposed in the first top end with the top longitudinal portion extending into a first slot in the first rectangular end and a post end with a first cross-hole disposed inside the first post;

positioning a first pin in the first cross-hole and an aperture with the first post;

attaching the top rail to the second post with a second top rail link comprising a second rectangular end disposed in the second top end with the top longitudinal portion extending into a second slot in the second rectangular end and a post end with a second cross-hole disposed inside the second post;

positioning a second pin in the second cross-hole and an aperture with the second post;

connecting the bottom rail to the first post with a first bottom rail link comprising a rectangular end disposed in the bottom rail and a T-shaped end disposed inside the first post, wherein the T-shaped end comprises a crossbar extending perpendicular to a vertical plane of the wire mesh and the T-shaped end is disposed through the first vertical slot in the first post with the crossbar positioned inside of the first post; and connecting the bottom rail to the second post with a second bottom rail link.

20. The method of claim 19, wherein the wire mesh is 358 wire mesh comprising 8-gauge wire with three inches between the vertical wires and 0.5 inch between the horizontal wires.

* * * * *